US005406725A

United States Patent [19]

Breese

[11] Patent Number: 5,406,725

[45] Date of Patent: Apr. 18, 1995

[54] METHOD AND APPARATUS FOR WATER BOTTOM REMOVAL OF BOTTOM MATERIAL

[76] Inventor: Dennison K. Breese, P.O. Box 888, Beaufort, N.C. 28516

[21] Appl. No.: 226,383

[22] Filed: Apr. 12, 1994

Related U.S. Application Data

[63] Continuation of Ser. No. 968, Jan. 6, 1993, abandoned.

[51] Int. Cl.[6] ..... E02F 3/83

[52] U.S. Cl. ..... 37/342; 405/73

[58] Field of Search ..... 405/73; 37/342, 344, 37/345, 307

[56] References Cited

U.S. PATENT DOCUMENTS

| | | | |
|---|---|---|---|
| 292,024 | 1/1884 | Mansfield | 37/78 |
| 2,856,704 | 10/1958 | Hebert | 37/75 |
| 3,440,743 | 4/1969 | Divine | 37/342 |
| 3,599,354 | 8/1971 | Larson | 37/78 |
| 3,629,963 | 12/1971 | Itami . | |
| 3,900,077 | 8/1975 | Gee et al. . | |
| 4,329,793 | 5/1982 | Reece . | |
| 4,819,347 | 4/1989 | Lofgren | 37/79 X |
| 4,991,997 | 2/1991 | Cowper | 405/73 |
| 5,249,378 | 10/1993 | Frame | 37/342 |

FOREIGN PATENT DOCUMENTS

| | | | |
|---|---|---|---|
| 2631359 | 11/1989 | France | 37/342 |

OTHER PUBLICATIONS

Agitation dredging: Lesson and Guidelines from Post Projects by Thomas W. Richardson, Hydraulic Laboratory, Vicksburg, Miss., Jul. 1984.

*Primary Examiner*—Randolph A. Reese
*Assistant Examiner*—Spencer Warnick
*Attorney, Agent, or Firm*—Hoffman, Wasson & Gitler

[57] ABSTRACT

An improved material movement system for use in a body of water for moving bottom materials. The system includes a vessel from which at least one propulsion unit is suspended and which has the ability to provide flow therefrom directed at a preselected angle toward the bottom. Deflector means are used with the propulsion units to control the direction of flow from the propulsion unit and to create pressure fluctuations in the flow from the propulsion which fluctuations are both low frequency and higher frequency. The pressure fluctuations, the deflection of the propulsion flow and other features are controlled by a central controlling computer. It is preferred that the high frequency fluctuations in the propulsion flow be controlled so that the frequency is adjusted to cause a maximum of excitation or movement of the bottom materials. This is done by propeller selection, speed of rotation and other factors under the control of the operator. The low pressure and low frequency fluctuations are controlled to arrive at the bottom in conjunction with the passing of a wave trough over the point on the bottom.

23 Claims, 6 Drawing Sheets

METHOD AND APPARATUS FOR WATER BOTTOM REMOVAL OF BOTTOM MATERIAL

This is a continuation of application Ser. No. 08/000,968, filed on Jan. 6, 1993, now abandoned.

BACKGROUND

The present invention relates to an improved method and apparatus for moving bottom sand and other sediment to provide a change in the bottom profile at a specific location in the bottom of a body of water. The present invention accomplishes its movement of such material by utilizing propellers on a vessel at the water surface and movable plates to control the discharge from the propellers to both loosen the material and to transport the material away from its initial location.

The use of propellers has been tried prior to the present invention with limited success. The publication "AGITATION DREDGING: LESSONS AND GUIDELINES FROM PAST PROJECTS" by Thomas W. Richardson, Hydraulics Laboratory, Vicksburg, Miss., July 1984 and identified as 85 01 29 015. This article outlines the testing done by the Department of the Army, U.S. Army Corps of Engineers of the use of ships propellers and water jets in moving bottom material from preselected locations on the bottom of bodies of water. On page A18 they include a picture of a vessel named the "Salvage Chief" which has a hydraulically operated S-shaped deflector door which was used to deflect the prop wash from its propellers downward, to thereby concentrate and direct the flow and produce some sediment transport by induced currents. (See Paragraph 23 et seq.).

Other prior devices for moving bottom material are shown and disclosed in the following U.S. Pat. Nos. 3,629,963 (an underwater bulldozer operated from a ship by means of a cable); 3,900,077 (a platform mounted on telescoping legs and having tractor feet on the lower ends thereof for resting on the bottom and a clam shell bucket which can be lowered to the bottom for scooping up quantities of bottom material); and 4,329,793 (a trenching implement suitable for towing on a sea bed to make a trench for a submarine cable or pipeline).

SUMMARY

The present invention provides the improved method and apparatus for moving material from a water bottom location which includes directing the liquid flow from at least one propeller in a manner to cause the bottom material to be loosened and then transported from its location. This is done by the movement of plates directing the flow so that the flow is directed at the location where material movement is desired and in such a manner to create reductions in pressure at the bottom location and with a preselected frequency to cause a loosening of the particles. The flow also transports the loosened and moving material particles to be moved away from their original location to a suitable location which does not cause the particles to settle back near their original location. In the preferred improved apparatus, a vessel with minimum draft is provided with four driven propellers which can be raised, lowered, rotated and tilted together with suitable controls so that the propellers not only move the bottom material but also provide a dynamic positioning of the vessel. The flow of water from the propellers is directed by movable plates or vanes so that it is moved toward the bottom at the desired angle and also the flow is modified to create waves of reduced pressure directed downward. It is also advantageous to cause said reduced pressure waves to be controlled to occur at the same time as surface wave troughs pass over the area of the bottom from which material is to be moved. Additionally, the propellers and their speed of rotation are preselected to provide a prop wash which has a frequency which will cause a random movement of the bottom particles to aid in the initial loosening of the particles from their tightly packed position on the bottom.

An object of the present invention is to provide an improved method of dredging material from a position located on the bottom in a body of water which has improved efficiency in the movement of such material.

Another object of the present invention is to provide an improved method of dredging material from a water bottom which includes an improvement in the release of the material from the bottom.

A further object of the present invention is to provide an improved apparatus of dredging material from a water bottom location which utilizes water flow from propellers at frequencies which improve the release of bottom material.

BRIEF DESCRIPTION OF THE DRAWINGS

These and other objects and advantages are hereinafter set forth and described with reference to the drawings wherein.

DESCRIPTION OF THE PREFERRED EMBODIMENTS

Figure 1:
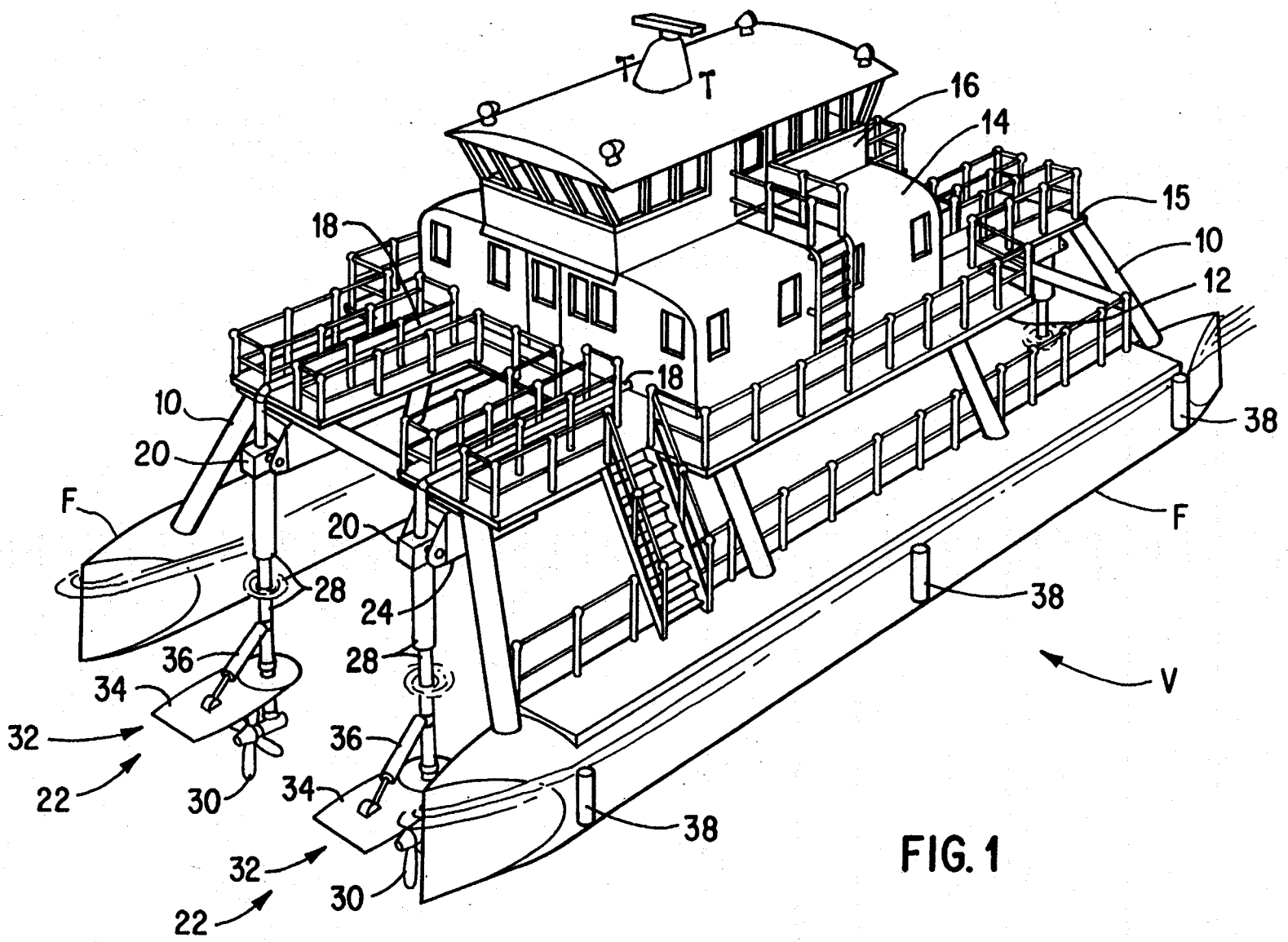
FIG. 1 is a perspective view of an improved vessel of the present invention to be used for the digging of bottom material in a body of water.

Vessel V, as shown in FIG. 1, is an apparatus embodying the preferred form of the improved apparatus of the present invention and with which the improved method of the present invention may be performed. Vessel V includes a pair of tubular flotation members or pontoons F which are generally parallel and spaced apart from each other. Frame members 10 extend upwardly from pontoons F and support elevated deck 12 at a position above the space between pontoons F. Superstructure 14 on deck 12 on its lower level 15 provides space for engine rooms with pilot house 16 positioned above lower level 15. Suitable engines (not shown) such as diesel engines, are housed in the engine rooms on lower level 15 of superstructure 14 with suitable hydraulic conduits 18 extending therefrom to control units 20 of the propeller units 22. The propeller units 22, preferably four in number, two forward and two aft, are suspended from deck 12 by brackets 24 and include control unit 20, drive shafts 28 and propellers 30 with deflector means 32 provided in association with each of propellers 30. Control unit 20 is preferred to include the power means for driving propellers 30, the means for raising and lowering propellers 30 and the means for pivoting and rotating drive shafts to control the positions of propellers 30 as hereinafter explained. With this arrangement, which is available from reputable suppliers, the operation of the propeller units 22 can be controlled so that the speed of the propellers 30 is controlled, their depth in the water is controlled and the direction of their prop wash or discharge is controlled. In cooperation with deflector means 32, which includes deflector plate 34 and actuator 36, the prop wash or discharge from each of the propellers 32 is individually controlled to obtain the maximum amount of movement of the particles on the bottom of the water body and to cause its movement to be controlled in the direction or directions preselected by the operator.

A sensing system to provide information regarding the wave movement past the vessel V is provided. This system includes sensing units 38 which are suitably mounted on the exterior of pontoons F or other suitable location, and the pitch and roll sensor 40 which senses the pitch and roll movements of vessel V.

Figure 1A:
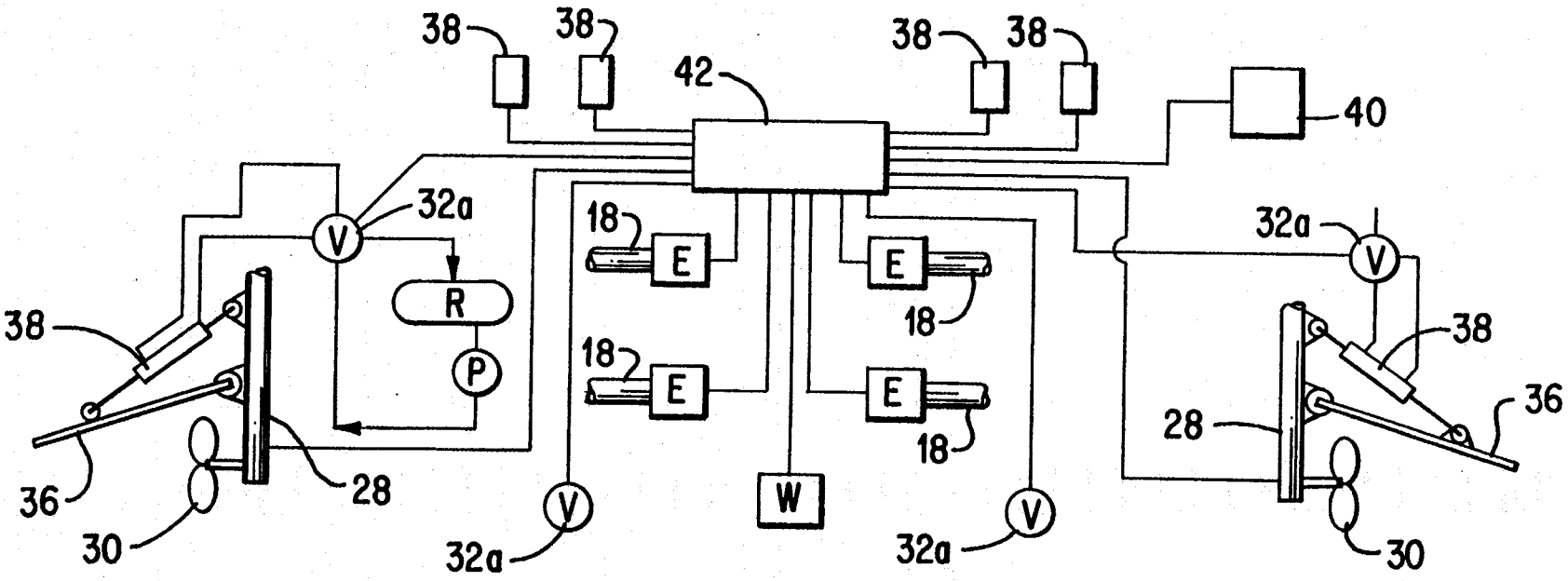
FIG. 1A is a schematic drawing of the controls used in conjunction with the vessel, its engines, its propellers, the deflection plates and the sensing instrumentation, all of which are connected to and under the control of a controller.

The control of the operations of the units described is illustrated in FIG. 1A. The control is provided by a suitable computer 42 which receives input from sensors 38 and 40, from preselected programs and operator input during operations. Computer 42 is also connected to operate the engines E which produce the hydraulic fluid under pressure which is delivered to propeller units 22 through hydraulic conduits 18 and controls valves **32*a* which control the operation of deflector means 32. Fluid for operation of deflector means 32 is provided in reservoir R and pumped by pump P to valve 32*a* which is controlled by computer 42 so that deflector plate 36 moves exactly as desired. Thus computer 42 controls the complete operations of the unit including the speed of propellers 30, their depth, their direction of discharge which is controlled by the tilting of drive shafts 28 and by rotation of lower portion of drive shaft 28 to cause propellers 30 to tilt and the movement of deflector means 32**. This system of control can be used to control not only the high frequency vibrations in the propeller discharge but also the low frequency waves which can be coordinated with the passage of wave troughs to reach the bottom at the exact time a wave trough passes of the location.

It has been discovered that the creation of a low pressure wave directly above a bottom location causes the bottom particles to be raised from the packed bottom material. It is believed that this is the result of such low pressure being above the bottom and the water within the packed material being at a higher pressure moves upward responsive to such low pressure wave, thus making such bottom material particles free of the compacted bottom material bed and thereby entraining them in the flow stream from the propellers 30 to move them to a preselected location.

It has also been discovered that if the propeller flow stream includes pulses at a preselected frequency, it will cause the particles of the bottom material at the bottom location to have a responsive movement or stated another way to be excited by such pulses that they have a responsive vibratory movement so that they are easily entrained in the propeller flow stream and carried to the bottom location desired for settling.

The combination of the pulses and the low pressure waves are believed to have a very decided improved movement of the bottom particles from the bottom location and such improvement results from the loosening of a much larger amount of particles from the compacted bed of materials at the bottom.

Another feature of the present invention is that the use of a plurality of propellers 30 on a ship such as vessel V can be used not only for the directing of suitable flow streams at the bottom location to cause the improved movement of material therefrom but also can be used to provide dynamic positioning of vessel V with respect to its location above the bottom location and also with respect to the damping of roll and pitch movement with respect to the passage of waves. Any suitable devices which are known and in use may be used to provide the desired input for the dynamic positioning of the vessel. Typical examples are the use of the usual navigational aids, such as satellites etc, the use of a taut wire system suspended below the center of vessel V, with a suitable weight to carry it to the bottom and also with suitable pressure sensing and location sensing apparatus to provide input for both the location control, the control of pitch and roll and the actual control of the generation of low pressure waves to reach the bottom at the same time that the pressure lower at the bottom location as a result of the passage of the trough of a wave at the surface. It is believed that proper timing of the movement of deflector means 32 creates this stabilization and also creates the low pressure wave in coordination with the passage of surface waves and also directs the prop wash at the desired location so that the improved material movement from the bottom location is achieved. Further, this allows the operation of vessel V in surf and during bad weather.

Figure 2:
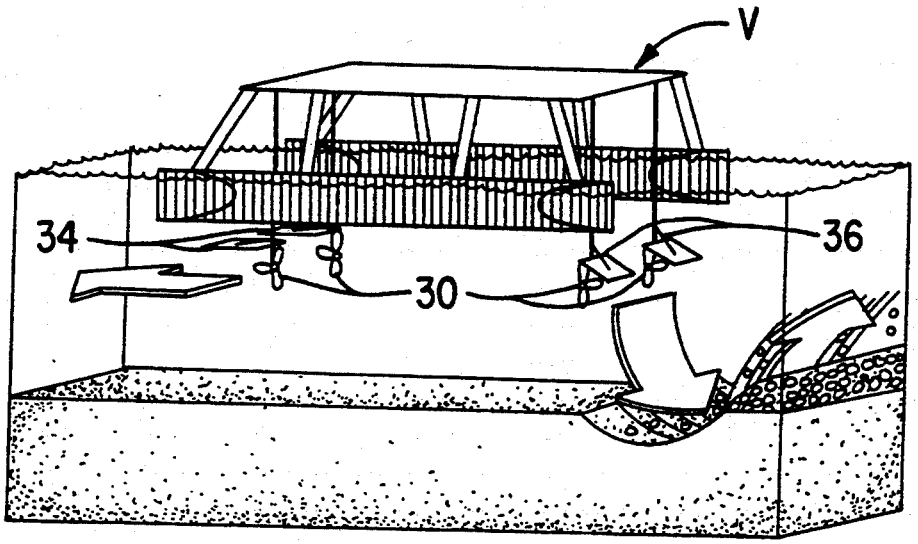
FIG. 2 is a schematic illustration of the improved vessel of the present invention using two propellers for digging and two for generation of counter thrust.
Figure 3:
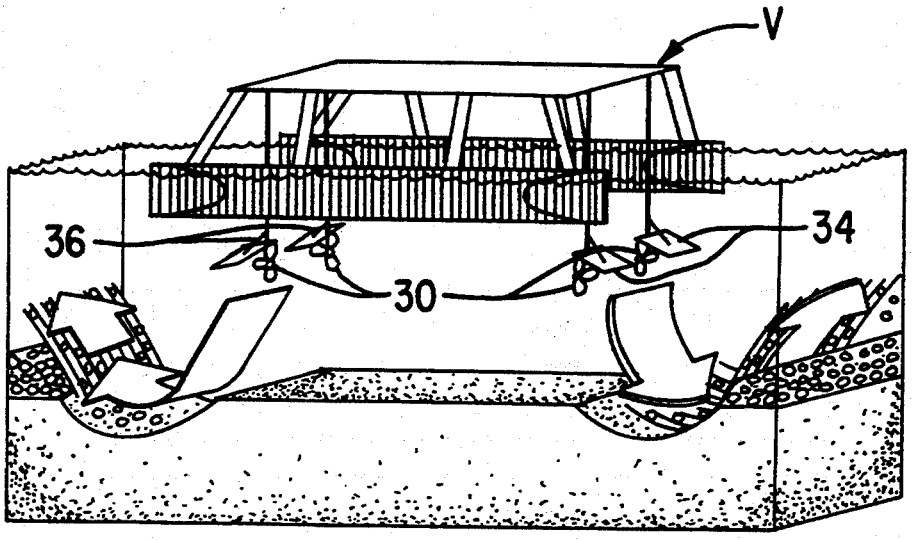
FIG. 3 is another schematic illustration of the improved vessel digging with all four propellers thrusting outward.
Figure 4:
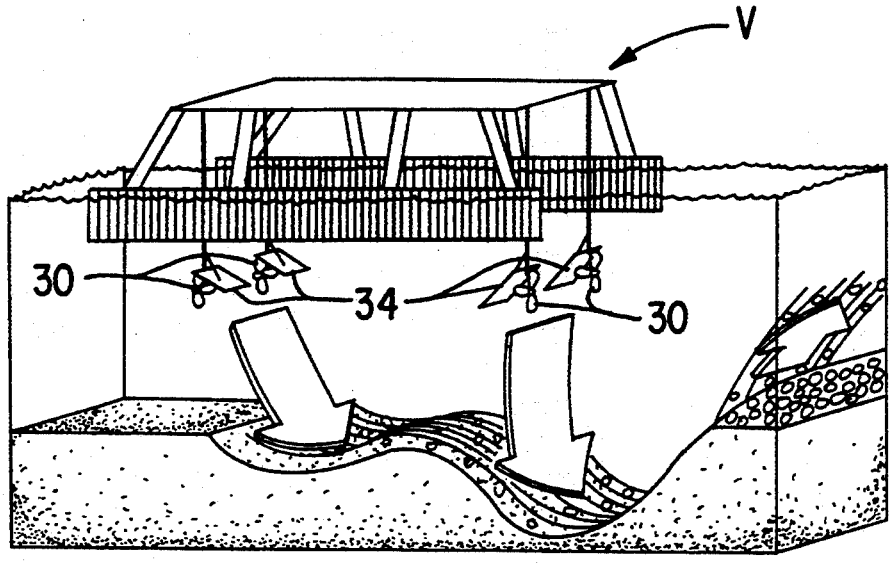
FIG. 4 is another schematic illustration of the improved vessel in which the digging is accomplished with the propellers all thrusting inward.
Figure 5:
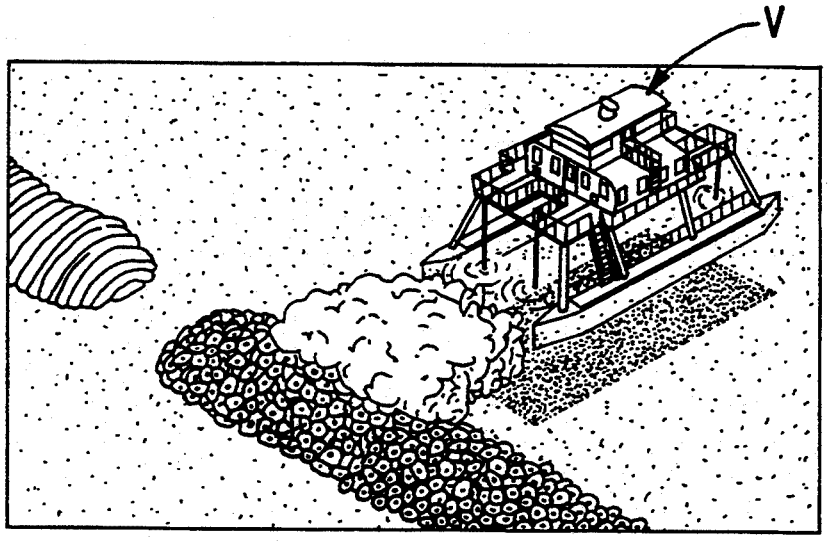
FIG. 5 is a schematic illustration of the improved vessel used on a beach to build a berm or covering for beach protection or backfilling.

In the schematic illustration of FIG. 2, vessel V is illustrated in a configuration which enables it to dig with two of its propellers. In FIG. 3 another configuration is shown in which vessel V is digging with all four propellers thrusting outward. In FIG. 4 Vessel V is enables to dig with all four propellers thrusting inward and in FIG. 5 vessel V is position to build a berm or covering for beach protection or backfilling. These illustrations show a few of the possible configuration in the operation of vessel V and many other configurations are possible in view of the extensive adaptability of the improved dredging system of the present invention.

In the FIG. 6 series of schematic illustrations, it has been attempted to illustrate the coaction between the propeller and the deflector plate. In FIG. 6A, the flow from propeller 30 with deflector plate 34 being held stationary at an angle of 30° so that the water flow is directed downwardly. In FIG. 6B the plate 34 has moved to 40° at a 10° per second rate. This causes the flow to be directed downwardly at an angle steeper than shown in FIG. 6A. In FIG. 6C the plate 34 has stopped at the 40° slope and begins its return movement.

Figure 6A:
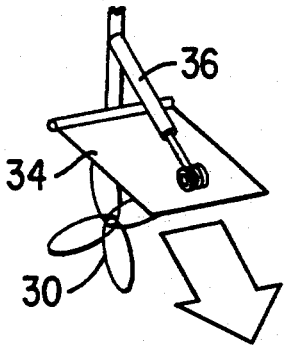
FIG. 6 is a series of depictions (FIGS. 6A through 6F) of a propeller and deflector plate in their cooperation to generate a low pressure wave.
Figure 6B:
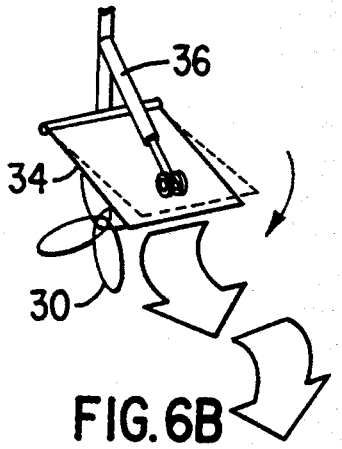
Figure 6C:
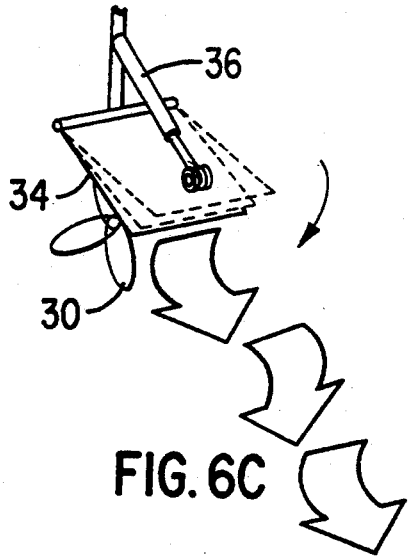
Figure 6D:
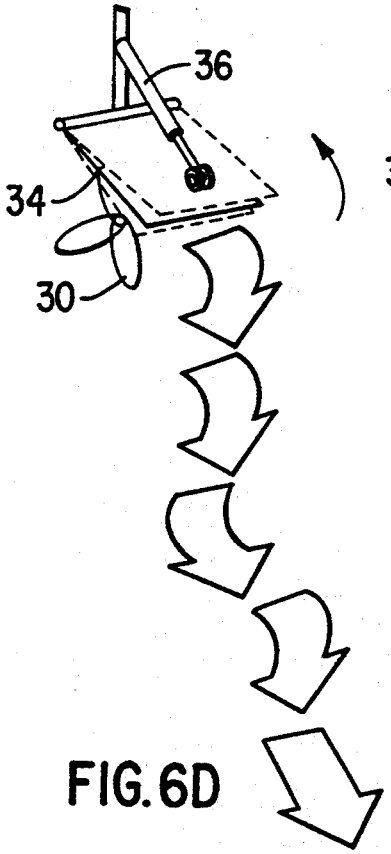
Figure 6E:
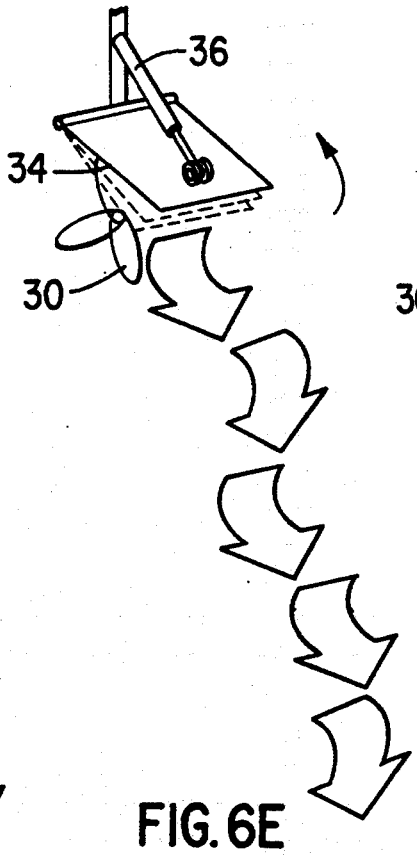
Figure 6F:
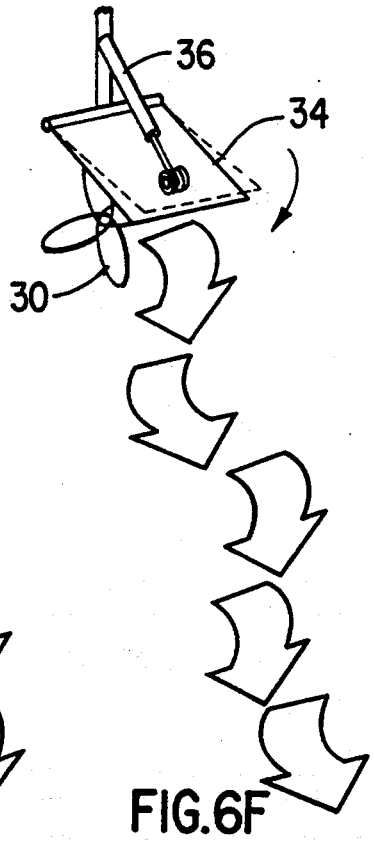

In FIG. 6D, plate 34 is shown at 30° and moving to 20°. In FIG. 6E, plate 34 is illustrated at 20° and returning to 30°. FIG. 6F illustrates the asymmetrical flow resulting from the movement of plate 34. The deflectors are to divert the horizontal flow from the propellers downward at angles from 0°–45° which will fluidize the sediment and transport it. The average deflection during digging will be 20°–37°. The deflector angle is controlled from the pilot house with suitable position indicators for each of the deflector plates. Low pressure wave generation is accomplished by moving the deflector plates up and down as shown in the drawings.

Figure 8:
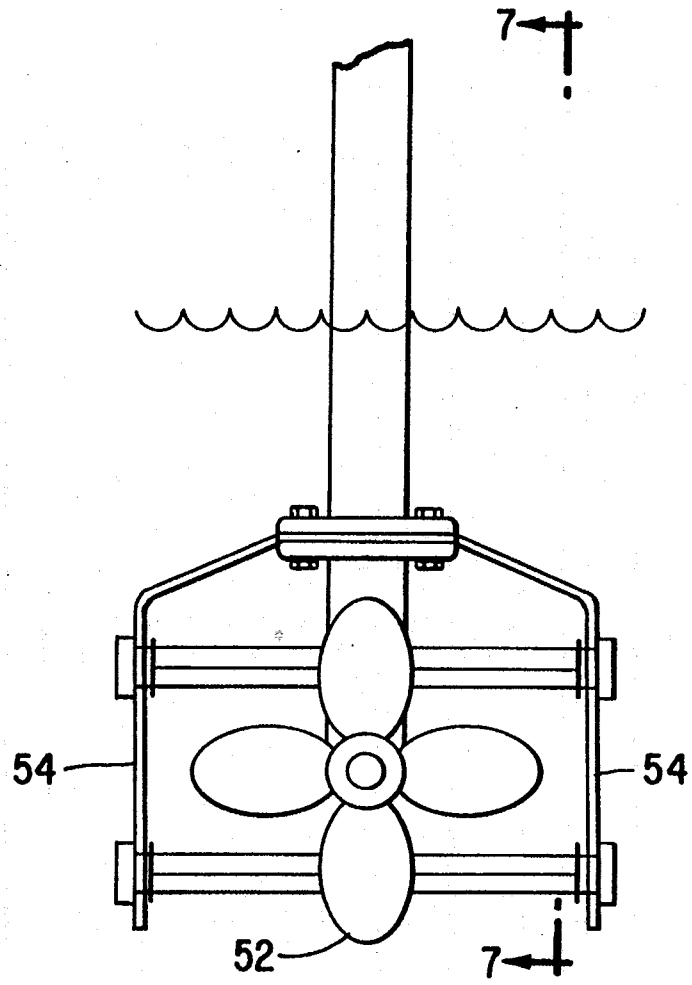
FIG. 8 is a front view of the propeller and two element deflector plate configuration shown in FIG. 7.
Figure 7:
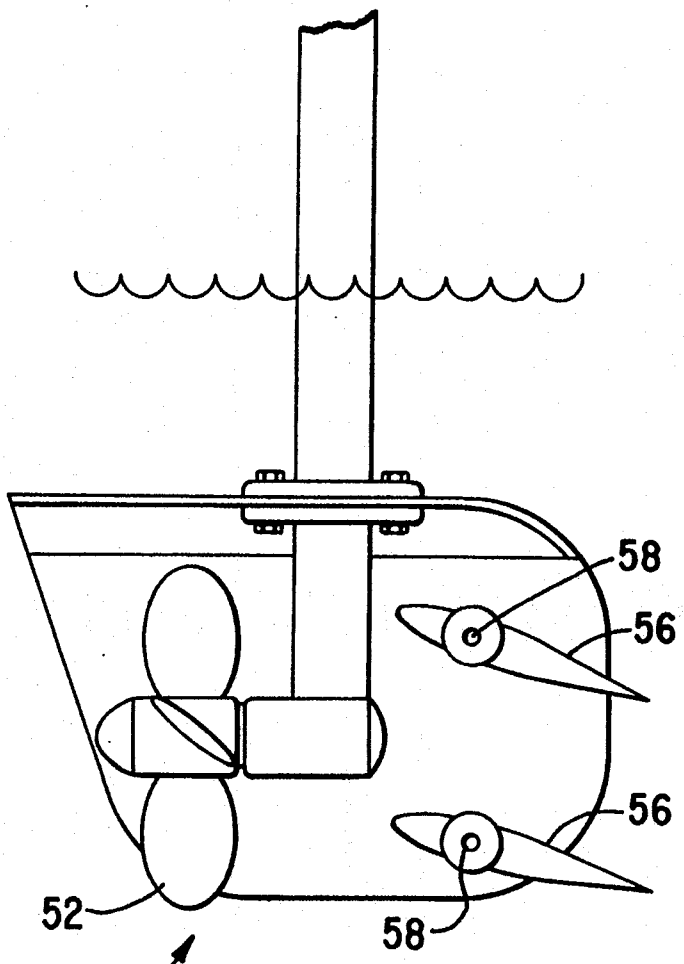
FIG. 7 is a view of a propeller having a two element deflector plate for deflecting the water flow issuing from the turning propeller.

The propulsion unit 50 shown in FIGS. 7 and 8, illustrates a modified form of propulsion units including propeller 52 supported from a suitable drive shaft 53, side plates 54 and multiple deflector plates 56 supported on shafts 58 so that they can be moved to desired positions. Two deflector plates 56 are illustrated in the drawings but more than two deflector plates 56 may be used if they provide an advantage for the particular operations of the system of the present invention. The shafts 58 or the plates 56 may be individually moved by hydraulic or electric actuators, which may either be connected on the exterior of side plates 54 or be connected thereto by suitable mechanism. As with other operations of the system it is preferred to control the position of plates 56 from the pilot house 16 by connecting controller computer 42 to the movement means for the plates and to provide indications of the plate positions to the controller 42.

What is claimed is:

1. The improved method of moving sea bed material at the bottom of a body of water including the steps of directing a flow of water having a constant velocity, toward the bottom at the location from which sea bed material is to be removed, and moving deflector plates during said directing step to create intermittent low pressure waves in said flow of water which reduce the water pressure on the bottom to less than the normal head pressure to loosen sea bed material from the bottom to allow the water flow to transport the loosened sea bed material from the location.

2. The improved method of moving material at the bottom of a body of water including the steps of directing a flow of water toward the bottom at the location from which material is to be removed, and moving deflector plates during said directing step to create intermittent low pressure waves in said flow of water which reduce the water pressure on the bottom to less than the normal head pressure to loosen material from the bottom to allow the water flow to transport the loosened material from the location, and preselecting a rotating propeller to impart such flow of water as a series of pulses which is related to the bottom material to cause it to vibrate at a preselected frequency characteristic of the sea bed material and thereby fluidize said bottom material to loosen its position in the bottom.

3. The method according to claim 2 wherein said step of creating said flow of water includes maintaining the rotation speed of a plurality of preselected propellers at fixed preselected speeds and includes the step of changing the direction of the flow of water from the propellers toward that portion of the bottom from which material is to be moved.

4. An apparatus for moving material from the bottom of a body of water comprising at least one preselected propeller, means supporting said propeller at a position in the water, means for rotating said propeller at a preselected rate of rotation, means for directing the flow of water from the propeller toward that portion of the bottom from which material is to be moved, and means for changing the position of said directing means during rotation of said propeller, to generate a low pressure wave in the flow of water which creates a rapid lowering of water pressure above the bottom material to loosen the material at the bottom to occupy a location above said bottom for transportation by the flow of water, said apparatus operating to move material from the bottom of a body of water while in an unanchored state.

5. Apparatus according to claim 4 including at least one deflector plate placed in the flow of water leaving said propeller, means mounting said deflector plate for movement relative to said flow of water, and means controlling the positioning and movement of said deflector plate to create said low pressure waves in said flow of water which are directed at the bottom location from which material is to be moved.

6. Apparatus according to claim 4 including a plurality of propellers each creating a flow of water, a plurality of movable deflector plates, one for each of the propellers, and means controlling the deflector plates to direct the flows of water to preselected locations on the bottom.

7. Apparatus according to claim 6 wherein the means supporting the propellers is a vessel.

8. Apparatus according to claim 6 including means controlling the movement of the deflector plates so that they generate low pressure waves directed toward the bottom which have a pressure on reaching the bottom which is less than the water head at the bottom.

9. Apparatus according to claim 8 wherein said controlling means provides a timing of the generation of the low pressure waves to reach the bottom at the same time as the passage of surface wave troughs over the preselected bottom location from which material is to be moved.

10. The method of moving material on the bottom of a body of water including the steps of establishing a constant velocity flowing stream of water, changing the direction of said stream relative to a bottom location from which material is to be moved while said flowing stream is established, said stream having flow characteristics of an intermittent downward flow stream interrupted by low pressure waves to provide both improved loosening of the material from the bottom and transporting the loosened material away from the bottom location.

11. The method according to claim 10 wherein said flowing stream wherein said low pressure pulses are sufficient for the improved loosening of the material from the bottom, and said flowing stream has sufficient volume and velocity to transport the loosened material from the bottom location to a suitable settling location.

12. The method according to claim 11 wherein said flowing stream includes a series of low pressure waves which upon reaching the bottom location cause a reduced pressure immediately above the bottom so that water within the bottom material under pressure of the water head tends to move upward carrying bottom material into the flowing stream of water.

13. The method according to claim 11 wherein said flowing stream includes pulsations at a frequency which excites the bottom material particles into motion.

14. The method according to claim 11 wherein said flowing stream includes a series of intermittent low pressure waves which upon reaching the bottom location cause a reduced pressure immediately above the bottom so that water within the bottom material under pressure of the water head tends to move upward carrying bottom material into the flowing stream of water, and a continuous series of pulsations at a frequency which excites the bottom material particles into motion.

15. The method according to claim 12 including the steps of sensing the normal surface waves at a location directly above the bottom location, and generating said low pressure waves in timed sequence to reach the bottom location at the same time as the trough of the surface waves passes over the bottom location to thereby increase the loosening of the particles of the bottom material.

16. An apparatus for moving material from the bottom of a body of water comprising a vessel, propulsion means supported on said vessel for generating a flow of pulsating water directed downwardly which includes a series of downwardly directed flow pulses interrupted by reduced pressure pulses which reduce the pressure on the bottom below the normal head pressure at the bottom, means for changing the direction of the flow of water from said propulsion means during operation of said propulsion means, and means for controlling the pulsation in the water flow, said vessel being unanchored during operation of the apparatus.

17. An apparatus according to claim 16 wherein said propulsion means on said vessel provides dynamically positioning said vessel in a body of water and moving said vessel in a preselected track over the bottom of said body of water.

18. An apparatus according to claim 17 wherein said positioning means includes means to stabilize the roll and pitch of said vessel in the body of water.

19. An apparatus according to claim 16 wherein said propulsion means includes a plurality of propulsion means which can be moved to direct flow in any direction including downwardly, and said propulsion means provide a series of downwardly directed transporting pulses interrupted by a series of low pressure loosening pulses which reduce pressure on the bottom material sufficiently to cause internal water pressure in such bottom material to elevate the material so that the transporting pulses cause it to be transported from its original bottom location.

20. An apparatus for moving material from the bottom of a body of water comprising a plurality of preselected propellers, means for supporting said propellers at positions in the water, means for rotating said propellers at preselected rates of rotation, means for changing the direction of the flow of water from said propellers relative to that portion of the bottom from which material is to be moved while said propellers are in operation, and means for generating a low pressure wave in the flow of water which on reaching the bottom is lower than the head pressure on the bottom material to selectively liquify the material at the bottom for transportation of such material by the flow of water, said apparatus operating in an unanchored state.

21. An apparatus according to claim 20 including a plurality of movable deflector plates associated with each of said propellers and being placed in the flow of water leaving the propeller with which it is associated, means mounting said deflector plates for movement relative to said flow of water, and means controlling the positioning and movement of said deflector plates to create low pressure waves in the flow streams of water from said propellers which flows are directed at the bottom location from which material is to be moved.

22. An apparatus as recited in claim 5, further comprising two deflector plates placed in the flow of water leaving said propeller.

23. An apparatus as recited in claim 4, wherein said at least one preselected propeller comprising four preselected propellers.

* * * * *